United States Patent [19]

Kishino et al.

[11] Patent Number: 4,486,749

[45] Date of Patent: Dec. 4, 1984

[54] FLUORESCENT DISPLAY DEVICE

[75] Inventors: Takao Kishino; Tadashi Funazaki; Toshihiro Yamaguchi, all of Mobara, Japan

[73] Assignee: Futaba Denshi Kogyo Kabushiki Kaisha, Mobara, Japan

[21] Appl. No.: 384,481

[22] Filed: Jun. 3, 1982

[30] Foreign Application Priority Data

Jun. 8, 1981 [JP] Japan ..... 56-86785

[51] Int. Cl.[3] ..... G09G 3/28

[52] U.S. Cl. ..... 340/772; 340/752; 340/775

[58] Field of Search ..... 340/752, 772, 775, 771, 340/759; 313/496, 517; 315/169.4

[56] References Cited

U.S. PATENT DOCUMENTS

| | | | |
|---|---|---|---|
| 3,925,703 | 9/1975 | Schermerhorn | 340/775 |
| 4,044,349 | 8/1977 | Andoh et al. | 340/775 |
| 4,178,593 | 12/1979 | Kishino et al. | 340/772 |
| 4,303,917 | 12/1981 | Kishino et al. | 340/772 |

*Primary Examiner*—Gerald L. Brigance

*Attorney, Agent, or Firm*—Oblon, Fisher, Spivak, McClelland & Maier

[57] ABSTRACT

A fluorescent display device having a plurality of anodes arranged in the form of a matrix having rows and columns. Each anode arranged on the same row is connected together at intervals of two anodes and control electrodes are disposed opposite to each two anodes respectively on a column-by-column basis.

3 Claims, 9 Drawing Figures

FLUORESCENT DISPLAY DEVICE

BACKGROUND OF THE INVENTION

1. Field of the Invention

This invention generally relates to a fluorescent display device, and more particularly to a fluorescent display device in which dot-shaped anodes are arranged in the form of a matrix so as to display numerals, characters, graphic forms and the like.

2. Description of the Prior Art

A fluorescent display device, in which thermions emitted from a heated filamentary cathode are made to impinge on phosphor-coated anodes so as to effect displays, is widely used as the display device of electronic equipment or the like, because of its fine color of light emitted, capability of being driven on a low voltage, low power consumption, etc. In the fluorescent display device which is generally known as a dot-matrix type, the phosphor-coated anodes are arranged in the form of a matrix and connected together on a row-by-row basis, while disposing control electodes above the anodes on a column-by-column basis in opposed relationship thereto, and the anode positioned at the point of the intersection of the selected row and column is made to luminesce. The recent diversification of informations produced by various electronic equipment requires a fluorescent display device having the display dots arranged in a high density so as to effect the display with a high resolving power.

In order to arrange the display dots in the high density, two technical problems must be settled. The first problem is a display defect created at an edge of anodes A as shown in FIG. 8 which is resulted from a deflection of passages of electrons e from a cathode C to the anodes A by a negative electric field created by control electrodes G' adjacent to a control electrode G opposite to the anode A to be energized. This display defect is created, because intervals between each of the control electrodes become narrow in association with the arrangement of the anodes in the high density. In the fluorescent display device of this type, a dynamic driving system is generally used so as to decrease a number of outer terminals connected to each of the anodes and to scan the control electrodes which are provided in number corresponding to the increased number of the anodes. Accordingly, the ratio of selecting period of one control electrode to one cycle of the scanning which is known as duty factor becomes smaller, which results in making the pulse width for scanning one control electrode narrow and decreasing luminance at the anodes. This is the second problem. In order to compensate the decreased luminance, the driving voltage must be increased contrary to the advantages of the fluorescent display device being driven at the low voltage.

SUMMARY OF THE INVENTION

Therefore, the present invention is intended to eliminate the above-mentioned disadvantages of the prior art.

It is an object of the present invention to provide a fluorescent display device which is capable of effecting displays of high luminance at relatively low voltage.

It is another object of the present invention to provide a fluorescent display device which can prevent electrons impinging upon anodes to be energized from being deflected by electric fields of the adjacent control electrodes, which makes it possible to effect display without having display defects.

It is still another object of the present invention to provide a fluorescent display device which is capable of effecting various kinds of displays in a high density and high resolution.

According to the present invention, the foregoing and other objects are attained by providing a fluorescent display device in which a plurality of anodes are arranged in the form of a matrix having rows and columns. Each anode arranged on the same row is connected together at intervals of two anodes and control electrodes are disposed opposite to each two anodes respectively on a column-by-column basis. The fluorescent display device of this invention is driven by selecting two adjacent control electrodes at the same time, which are, in turn, scanned to be shifted one by one, and applying display signals to the anode located on the side where selected two control electrodes are adjacent to one another.

DETAILED DESCRIPTION OF THE PREFERRED EMBODIMENTS

Now, a preferred embodiment of the present invention will be hereinafter described with reference to the accompanying drawings.

Figure 1:
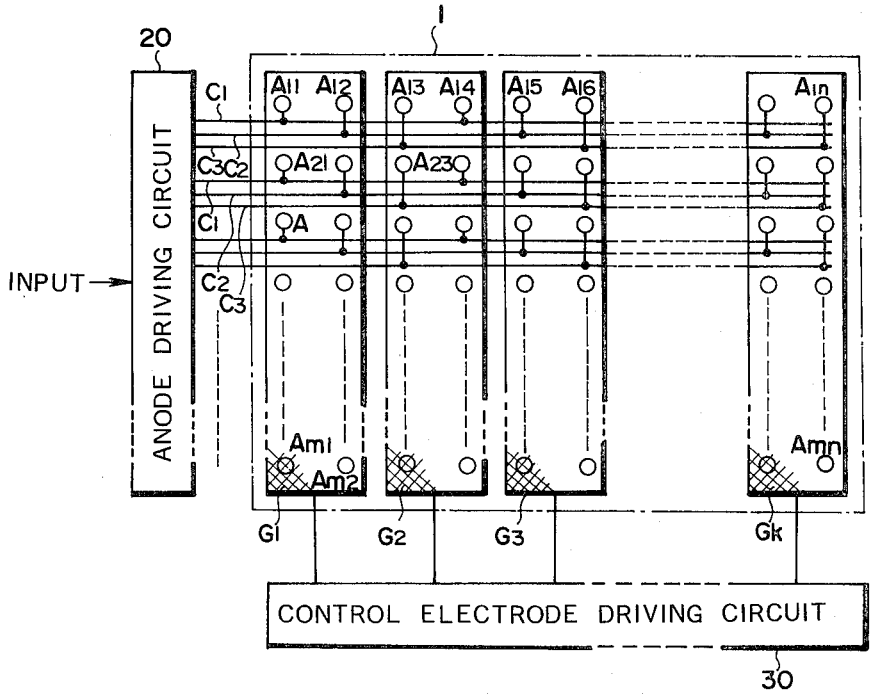
FIG. 1 is a diagrammatic view of a fluorescent display device according to an embodiment of the present invention.

A fluorescent display device shown in FIG. 1 includes a fluorescent display section 1 having a($m \times n$) number of dot-like anodes A($A_{11}$ - - - $A_{mn}$) arranged in the form of a matrix having m rows and n columns. Each row is provided with three wiring conductors $C_1$, $C_2$ and $C_3$ for connecting each anode A arranged on the same row together at intervals of two anodes. In other words, the anodes $A_{11}$, $A_{14}$, $A_{17}$ - - - disposed in the position which is expressed by the progression of $(3n-2)$ wherein n is a positive integral number are connected by the first wiring conductor $C_1$. In the same manner, the anodes $A_{12}$, $A_{15}$, $A_{17}$, - - - disposed in the position which is expressed by the progression of $(3n-2)$ n is a positive integral number are connected by the secong wiring conductor $C_2$ and the anodes $A_{13}$, $A_{16}$, $A_{19}$ - - - disposed in the position which is expressed by the progression of (3n) wherein n is a positive integral number are connected by the third wiring conductor $C_3$.

Reference numeral $G(G_1, G_2, - - - G_k)$ designates a control electrode which is in the form of, for instance, mesh-shape and disposed above the anodes A in opposed relationship thereto along the direction of the anode column across the wiring conductors $C_1$, $C_2$ and $C_3$, one for two columns of the anodes. Accordingly, the total number of the control electrodes G is one half of that of the anode columns. Reference numeral 20 is an anode driving circuit for applying display signals to the anodes A. Reference numeral 30 is a control electrode driving circuit for applying scanning signals to the control electrodes G.

When preparing the fluorescent display section 1 which includes the wiring structure explained above, it is possible to provide the wiring conductors $C_1$, $C_2$ and $C_3$ for connecting every two anodes A in each of the rows together on the same plane so as not to intersect with each other by arranging each of the wiring conductors $C_1$, $C_2$ and $C_3$ in parallel as shown in FIG. 1 if there is enough room for intervals between the anodes. On the other hand, when the wiring conductors $C_1$, $C_2$ and $C_3$ are difficult to form on the same plane, because the intervals between the anodes are too narrow, the anodes A and the wiring conductors $C_1$, $C_2$ and $C_3$ can be arranged by multi-layer interconnection technique.

Figure 2:
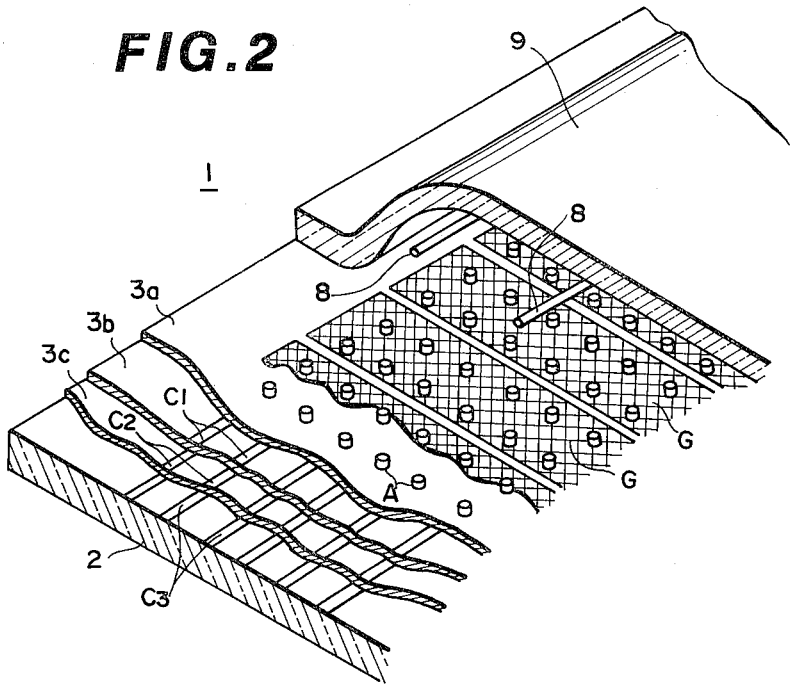
FIG. 2 is a perspective view, partly in section, showing the essential part of the fluorescent display device shown in FIG. 1.
Figure 3:
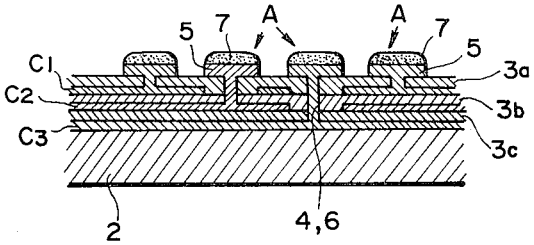
FIG. 3 is a fragmentary sectional view of the fluorescent display device showing an electrical connection of anodes.
Figure 4:
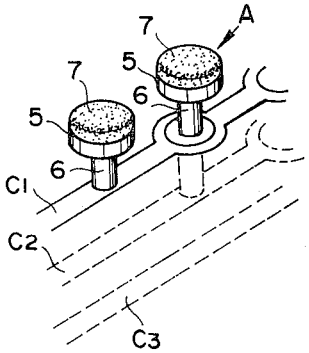
FIG. 4 is a perspective view of the anodes shown in FIG. 3.

Reference will now be made to an embodiment of the fluorescent display section 1 which is prepared by the multilayer interconnection technique with reference to FIG. 2. The fluorescent display section 1 includes a base plate 2 which is made of an insulator and forms a part of an envelope of the fluorescent display section 1. The base plate 2 has deposited thereon the wiring conductors $C_1$, $C_2$ and $C_3$ and insulating films 3*a*, 3*b*, and 3*c* alternately in superposed relationship by thick or thin film forming processes. At the predetermined positions of the insulating films, there are provided through-holes 4 communicating with the wiring conductors $C_1$, $C_2$ and $C_3$ and anode conductors 5 which are interconnected by means of conductors 6 filled in the through-holes 4 as shown in FIGS. 3 and 4. The upper surface of the anode conductors 5 has deposited thereon a phosphor layer 7 to form the anode A. The fluorescent display section 1 includes control electrodes G mounted above and opposite to the anodes A having a predetermined distance therebetween, and filamentary cathodes 8 stretched above and opposite to the control electrodes G. The base plate 2 on which the anodes A, control electrodes G and cathodes 8 are mounted is airtightly sealed by a front glass cover 9 forming a part of the envelope as shown in FIG. 2

Figure 6:
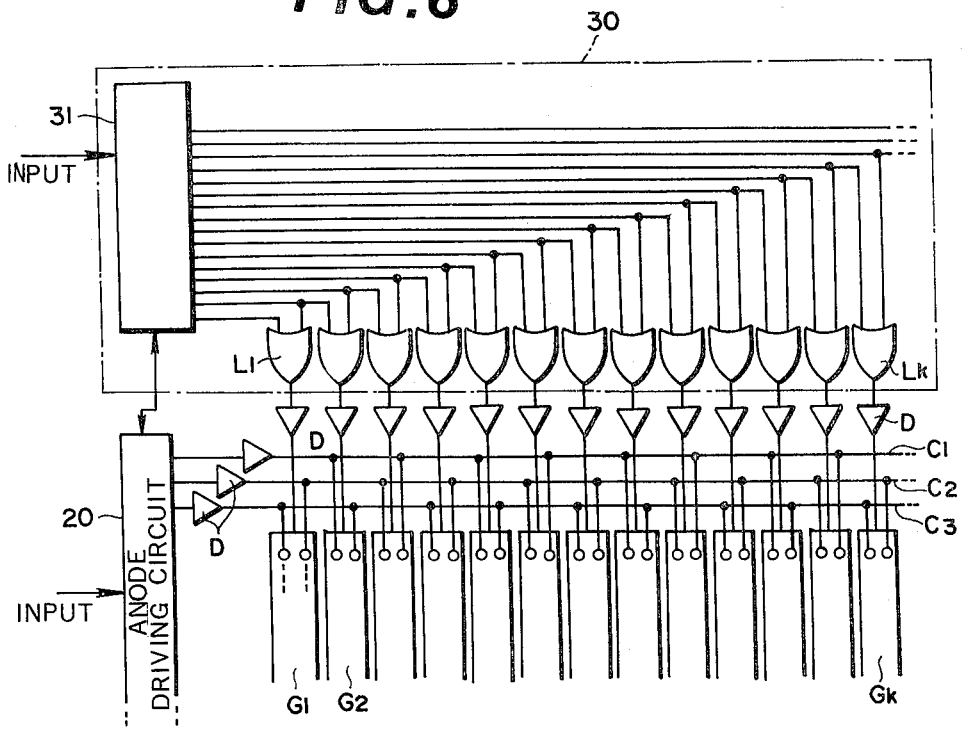
FIG. 6 is a schematic diagram of a control electrode driving circuit used in the fluorescent display device according to the present invention.

Driving signals to be applied to the anodes A and the control electrodes G are generated from the anode driving circuit 20 and the control electrode driving circuit 30 shown in FIG. 6. The control electrode driving circuit 30 selects adjacent two control electrodes at the same time and scans the control electrodes by shifting one by one. As shown in FIG. 6, the control electrode driving circuit 30 includes a decoder 31 having output terminals corresponding to the number of the control electrodes and OR circuits $L(L_1 - - - L_k)$ corresponding to the number of the output terminals. Each of the output terminals of the decoder 31 is connected to the adjacent two OR circuits L, respectively. Each of the outputs of the OR circuits is fed to each of the control electrodes $G(G_1, G_2 - - - G_k)$ by means of drivers D. Therefore, when the output of the decoder 31 is shifted one by one, two adjacent control electrodes can be scanned to be shifted one by one. The anode driving circuit 20 cyclically selects two of the wiring conductors $C_1$, $C_2$ and $C_3$ in synchronization with the scanning of the control electrodes G, and input signals corresponding to information to be displayed which are supplied from the outside are applied to the selected wiring conductors $C_1$, $C_2$ or $C_3$ so as to effect the display.

Figure 5:
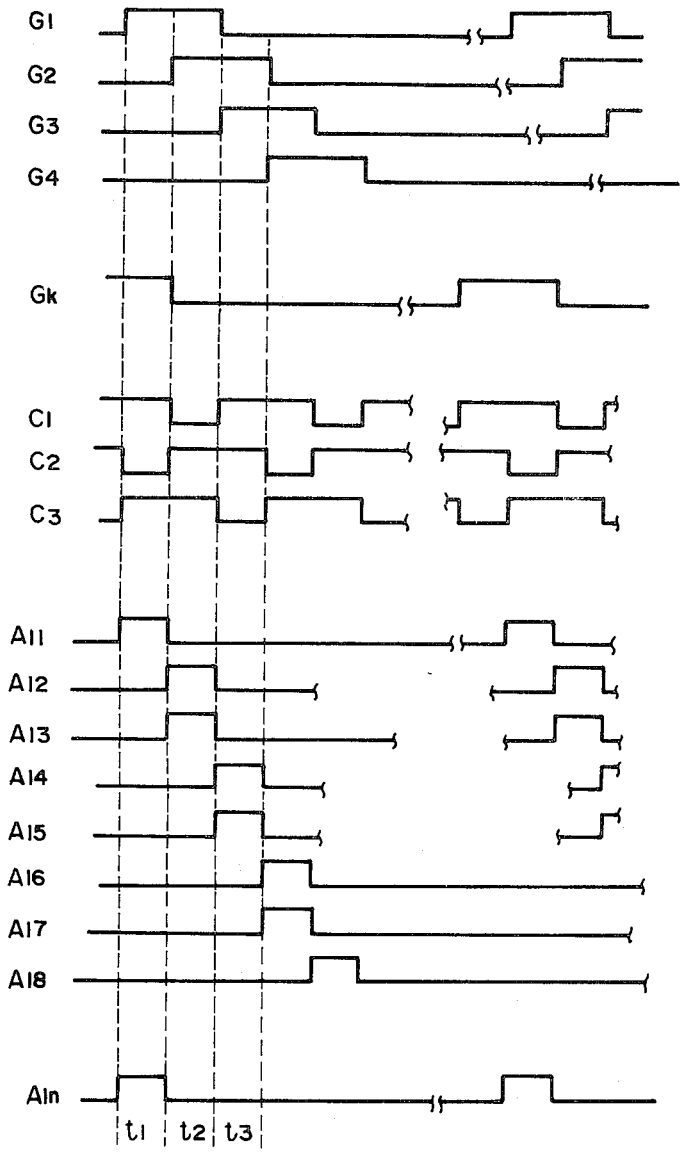
FIG. 5 is a timing diagram showning waveforms of scanning signals for the anodes and control electrodes.

Referring now to the operation of the fluorescent display device having the construction explained above, the control electrodes G are scanned so that the adjacent control electrodes G may be scanned simultaneously to be shifted one by one by the control electrode driving circuit 30 as shown in FIG. 5 $(G_1)$ - - - $(G_k)$. While, two of the wiring conductors $C_1$, $C_2$ and $C_3$ are cyclically selected by the anode driving circuit 20 as shown in FIG. 5 $(c_1)$ and $(C_3)$. Then, the inputs to be displayed are applied to the anodes A through the anode driving circuit 20 so as to effect the display. Referring to the anodes $A(A_{11} - - - A_{1n})$ disposed in the first row as for example, the anodes $A_{11}$ and $A_{1n}$ applying the display inputs are simultaneously illuminated during the period ti as shown in FIG. 5$(A_{11})$ and $(A_{1n})$, because the control electrodes $G_1$ and $G_k$ are scanned while being selected the wiring conductors $C_1$ and $C_3$ during this period. In the next period $t_2$ in which the control electrodes $G_1$ and $G_2$ and the wiring conductors $C_2$ and $C_3$ are selected, the anodes $A_{12}$ and $A_{13}$ are simultaneously illuminated as shown in FIG. 5$(A_{12})$ and $(A_{13})$ if the display inputs are given to these anodes. In the following period $t_3$, the anodes $A_{14}$ and $A_{15}$ are illuminated as shown in FIG. 5$(A_{14})$ and $(A_{15})$.

In this manner, the display is effected while driving two anodes at the same time by applying the display inputs to the anodes A which are disposed to be adjacent and isolated by the two control electrodes G being selected. Accordingly, the period of n/2 is required for scanning the anodes A of n number of columns and the ratio of displaying period of one anode A to one cycle of the scanning which is known as duty factor becomes two times higher as compared with the conventional method of scanning every anode A of n number of columns, which makes it possible to drive the fluorescent display device at a low voltage irrespective of an increase in a number of the anode and also the deminish flickering in the display.

Reference will be made to influence of the control electrodes G adjacent to the anode A being energized by taking the anode $A_{23}$ disposed in the second row and the third column shown in FIG. 1 as an example.

Figure 9:
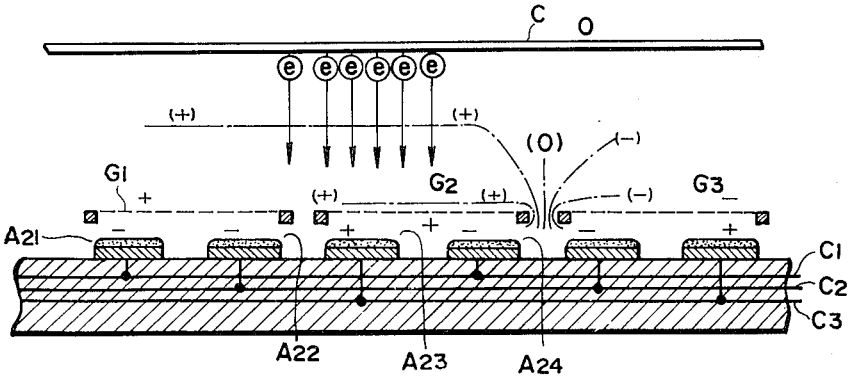
FIG. 9 is a schematical sectional view of the fluorescent display device according to the present invention prepared for the purpose of explaining the operation of the device.

The anode $A_{23}$ is made to luminesce when the control electrodes $G_1$ and $G_2$ are scanned at the same time, while applying inputs for permitting the anode $A_{23}$ to luminesce to the wiring conductor $C_3$. In this instance, the display inputs applied to the anodes $A_{12}$ - - - $A_{m2}$ on the second column concurrently with the anode $A_{23}$ are those which do not cause the anodes $A_{12}$ - - - $A_{m2}$ to luminesce. As shown in FIG. 9, when positive potential (+) is applied to the control electrodes $G_1$ and $G_2$ at the same time and the wiring conductor $C_3$ is selected and given the display inputs (+) for permitting to emit light, electrons e emitted from the cathode c are impinged upon only the anode $A_{23}$, thereby to cause the anode $A_{23}$ to luminesce. In this instance, the anode $A_{23}$ is sufficiently far from the control electrode $G_3$ to which negative potential is given. Thus, display defects in the anode $A_{23}$ can be prevented. Furthermore, repulsion of the electrons impinging upon the anode A to be energized by the electric field of the control electrodes adjacent to the anode A can be eliminated, because the positive potential is applied to these control electrodes at the same time. Accordingly, high-quality intricate display with no defect can be achieved at all the anodes even if the control electride is disposed in close proximity with each other.

FIG. 6 illustrates another embodiment of the control electrode driving circuit 30. The control electrode driving circuit 30 consists of a combination of shift registers which are set to be (1000 - - - 01) in advance and shift the number system cyclically so as to be (1100 - - - 00), (0110 - - - 00), (0011 - - - 00) in order. When the output of each shift register is used as the signal for scanning the control electrodes, the control electrodes G can be scanned at the timing as shown in FIG. 5($G_1$) - - - ($G_k$).

Figure 7:
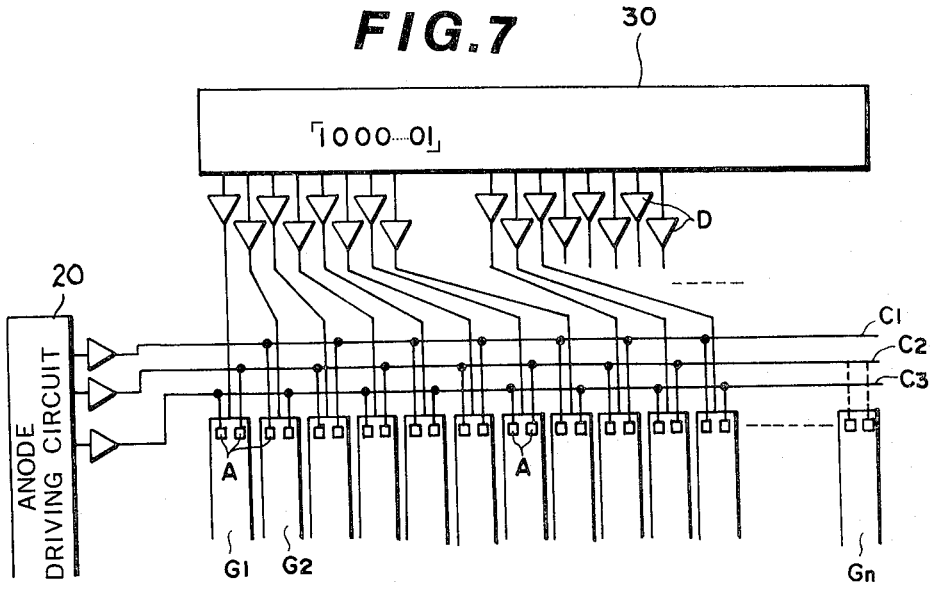
FIG. 7 is a schematic diagram of another embodiment of control electrode driving circuit used in the fluorescent display device of the present invention.
Figure 8:
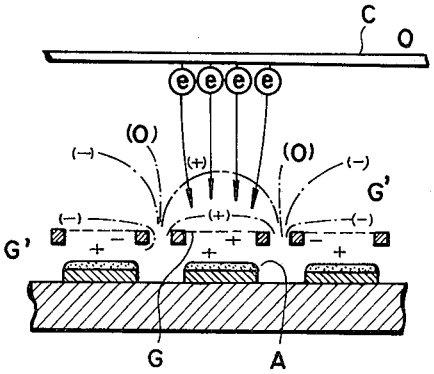
FIG. 8 is a schematical sectional view of a conventional fluorescent display device prepared for the purpose of explaining a problem inherent in the device.

It is to be understood that the fluorescent display device of the present invention can be driven at the timing as shown in FIG. 5 by using any optional driving circuit different from those shown in FIGS. 6 and 7. In the above embodiment, the present invention has been explained with reference to the fluorescent display device of the type which permits its display to observe from the side of the front glass cover. It is to be understood that the fluorescent display device may be formed so as to permit its display to observe from the side of the base plate by having the wiring conductor and the anode conductor formed of transparent conductive films.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A fluorescent display device for displaying characters, graphic forms and the like, comprising:

cathode means for emitting electrons;

means for selectively impinging said emitted electrons upon a plurality of phosper-coated anodes wherein said anodes are arranged in the form of a matrix of rows and columns wherein said phosphor-coated anodes on each of said rows are divided into a number of anode groups, each row containing a first group of anodes electrically connected in common whose column position is defined by the progression of (3N−2), N being a positive integer increasing in value from 1 to the value which represents the number of anode groups, a second group of anodes electrically connected in common whose column position is defined by the progression of (3N−1), and a third group of anodes electrically connected in common whose column position is defined by the progression of (3N):

a plurality of control electrodes with each control electrode disposed opposite to each set of two adjacent anode columns.

2. A fluorescent display device as defined in claim 1 further comprising a control electrode driving circuit for providing for scanning of the control electrodes whereby the scanning of said control electrodes is such that the respective adjacent two control electrodes are selected simultaneously and scanned in turn and an anode driving circuit for applying display signals to the respective adjacent two anodes which are disposed opposite to said selected adjacent two control electrodes and isolated thereby.

3. The fluorescent display device as defined in claim 1 wherein said control electrode driving circuit consists of shift registers.

* * * * *